United States Patent [19]

Cheng

[11] Patent Number: 4,840,822

[45] Date of Patent: Jun. 20, 1989

[54] DECORATIVE NETTING BOW AND METHOD OF MAKING SAME

[76] Inventor: Peter S. C. Cheng, 5 Ross Street, Toronto, Ontario, Canada, M5T 1Z8

[21] Appl. No.: 201,781

[22] Filed: Jun. 2, 1988

[51] Int. Cl.[4] ..... D04D 7/10

[52] U.S. Cl. ..... 428/4; 223/46; 428/255

[58] Field of Search ..... 428/4, 5, 255; 223/46

[56] References Cited

U.S. PATENT DOCUMENTS

| | | | |
|---|---|---|---|
| 2,473,528 | 6/1949 | Hoover | 428/227 |
| 3,539,431 | 11/1970 | Schmidt et al. | 428/4 |
| 3,560,313 | 2/1971 | Herkimer | 428/4 |
| 3,632,464 | 1/1972 | Grikis | 428/4 |
| 3,676,277 | 7/1972 | Truskolaski | 428/4 |
| 4,201,806 | 5/1980 | Cole | 428/4 |

*Primary Examiner*—Henry F. Epstein

*Attorney, Agent, or Firm*—Kirschstein, Ottinger, Israel & Schiffmiller

[57] ABSTRACT

An elongated netting has one end region movable toward an opposite end region to form multiple bow configurations for use as a gift wrapping product.

23 Claims, 4 Drawing Sheets

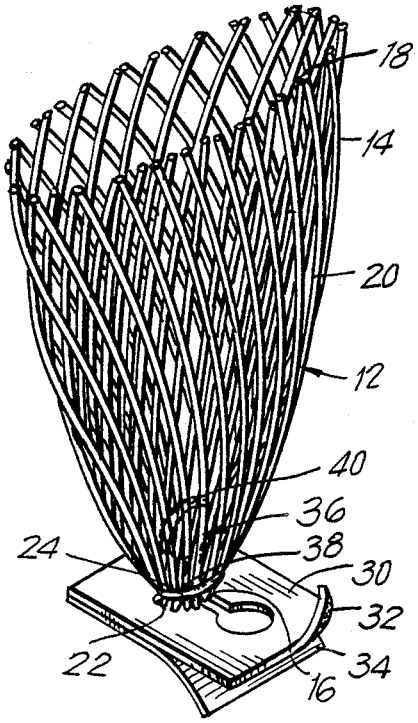
FIG. 1
FIG. 2
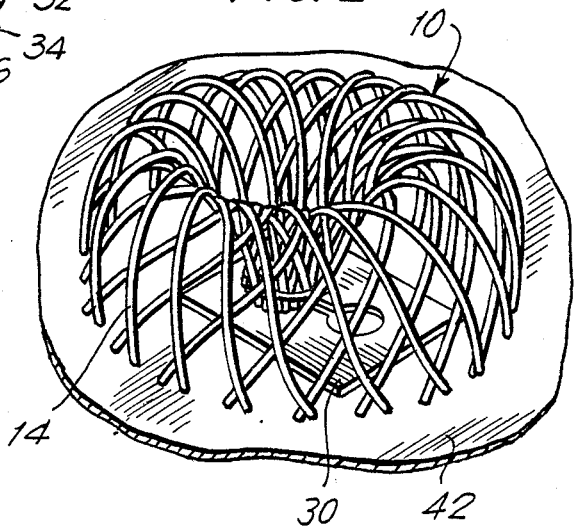
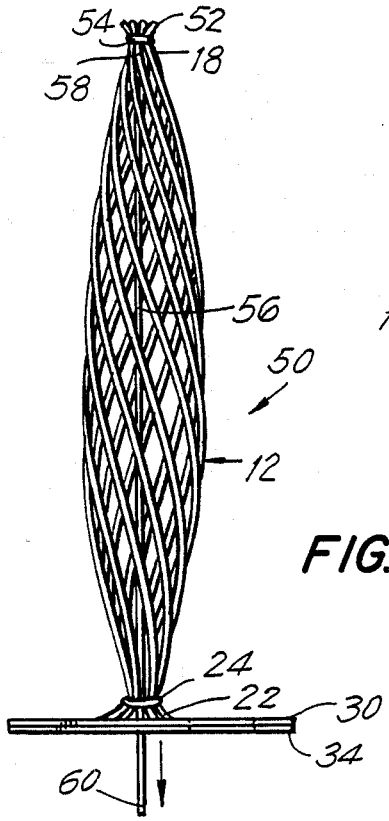
FIG. 3

FIG. 4
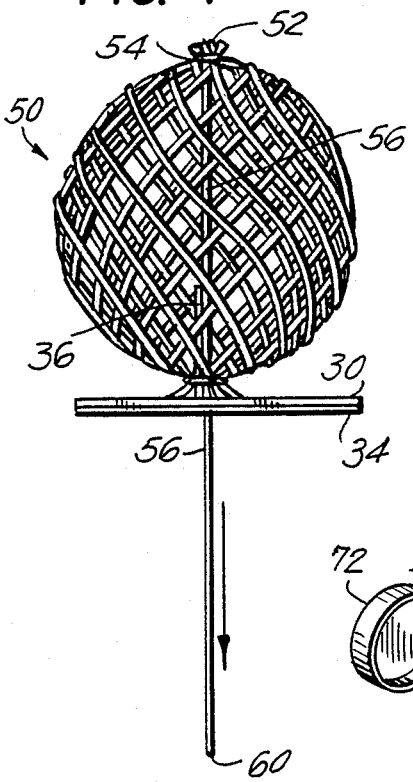
FIG. 5
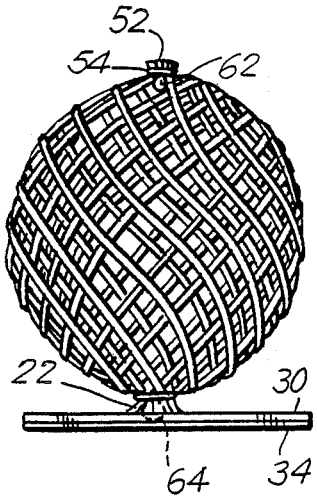
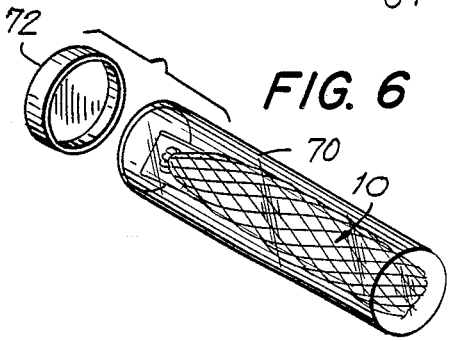
FIG. 6
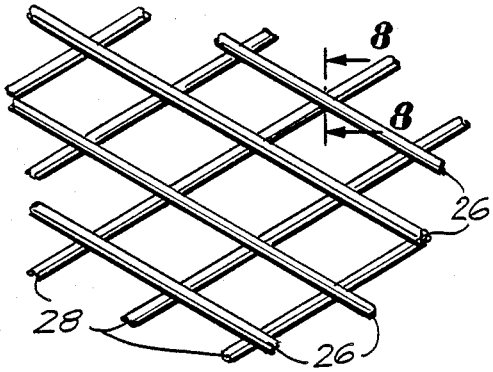
FIG. 7
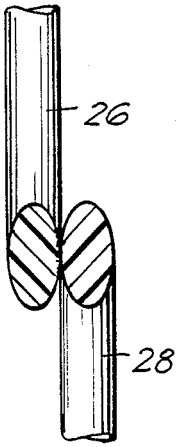
FIG. 8

DECORATIVE NETTING BOW AND METHOD OF MAKING SAME

BACKGROUND OF THE INVENTION

1. Field of the Invention

This invention generally relates to a decorative netting bow and a method of making same and, more particularly, to an elongated netting having one end movable toward an opposite end to form multiple bow configurations for decorating gifts and like objects.

2. Description of Related Art

In the art of gift wrapping, is desirable to provide a gift giver with esthetically pleasing decorations that are easy to apply on a gift or package so that the giver will readily utilize such decorations. The decorations should also be capable of being mass produced so as to bring down manufacturing costs and pricing without compromising the attractive appearance of the decorations. Pre-formed ribbon bows and bows formable in situ on the gift or package of the type exemplified by U.S. Pat. No. 3,632,464 are prevalent. Lace-like ribbon materials such as disclosed in U.S. Pat. No. 3,676,277 are also known. Crepe paper as disclosed in U.S. Pat. No. 3,560,313 has also been employed.

Although generally satisfactory for their intended purpose of decorating gift packages, the need persists for esthetically pleasing and unique decorating materials which are individualistic in appearance and yet produceable in large quantities and in a relatively short time so that the decorating materials are reasonably priced. Also, the decorating materials should be capable of being shipped, handled and assembled on the gift object without danger of damaging or compromising the esthetic value of the completed bow.

SUMMARY OF THE INVENTION

1. Objects of the Invention

It is a general object of this invention to overcome the aforementioned drawbacks of gift wrapping materials currently used.

It is another object of this invention to provide a new decorating material which is inexpensive to manufacture on a mass-production basis.

Another object of this invention is to ship decorating materials in a densely packed state without damaging the materials.

A further object of this invention is to provide a novel decorating material which is easy to handle and form in situ into a bow with minimal expenditure of time and additional materials, and without requiring any gift wrapping expertise.

Still another object of this invention is to provide a highly ornamental and individualistic bow for adorning gifts and like objects.

Yet another object of this invention is to provide a novel method of making an ornamental bow with the use of netting materials.

2. Features of the Invention

In keeping with these objects, and others which will become apparent hereinafter, one feature of this invention resides, briefly stated, in a bow-forming decoration and method of making the same which comprise utilizing a netting having pliable elongated strands of synthetic plastic material, preferably expanded foam or non-expanded foam, intersecting one another and forming an openwork pattern having open spaces. The strands are joined, e.g. by heat fusion, at their points of intersection.

The netting is initially elongated and extends longitudinally along an axis from one axial end region of the netting to an opposite axial end region thereof. Between the end regions, the netting has a circumferentially-complete central region extending circumferentially about said axis for a predetermined peripheral distance.

The strands have stationary end portions at said one axial end region. These stationary end portions are gathered in a common bunch. In a preferred embodiment, a tongue of a mounting sheet is captured between the gathered stationary end portions, and the entire assembly is tied by a common tie.

The strands also have movable end portions at said opposite axial and region of the netting. These movable end portions extend circumferentially about said axis along a path whose length may be longer, equal to or shorter that said predetermined peripheral distance of the central region. These movable end portions are displaceable toward said common bunch. During this displacement, a decorative bow is formed.

In a preferred embodiment, the strands comprise first and second sets of strands, each set extending between the end regions of the netting along different directions which are inclined relative to each other. Advantageously, the sets form the open spaces with a quadrilateral shape and, preferably, a rhomboidal shape.

In another embodiment, the two sets of strands change directions between the end regions of the netting. These directions are different from the aforementioned directions, and impart a different appearance to the formed bow.

The netting is re-configurable between a bow-unformed and a bow-formed condition in several manners. In one embodiment in which the netting is generally conically shaped in the bow-unformed condition, because the circumferential length of the movable end portions is greater than the peripheral distance of the central region, the movable end portions are displaceable radially outwardly and downwardly toward the stationary end portions. During this displacement, the opposite axial end region of the netting is foldable in an inside-outside manner over the central region, thereby imparting a mushroom-like or umbrella-like shape to the formed bow.

In another embodiment in which the one axial end region and the central region of the netting are generally conically shaped, while the opposite axial end region is generally cylindrically shaped, in the bow-unformed condition, due to a change in the directions of the sets of strands composing the netting, the movable end portions are displaceable radially outwardly and toward the stationary end portions as before, but this time, the bow is formed with a crown-like shape, not only due to the cylindrical shape of said opposite axial end region, but also because the circumferential length of the movable end portions is slightly smaller than the peripheral distance of the central region.

Another embodiment provides that the circumferential length of the movable end portions is much smaller than said peripheral distance of the central region. By displacing the movable end portions radially outwardly and toward the stationary end portions, and then by tucking the movable end portions behind the stationary end portions, a generally spherical-like bow is formed.

In yet another embodiment, the movable end portions are gathered in a common bundle to which one end of a drawstring is connected. The drawstring is routed interiorly through the netting and, with freedom of movement, through said common bunch. In use, a user pulls the opposite end of the drawstring along the axis, thereby axially pulling the movable end portions toward the common bunch and forming a generally spherical-like bow.

In still another embodiment, the drawstring is eliminated, and a fastening means is provided at the common bundle. A complementary fastening means is provided at the common bunch. In use, the user pushes one fastening means into engagement with the complementary fastening means along the axial direction to form a bow, The fastening means may advantageously comprise snap-type fasteners or pressure-sensitive adhesives.

In each of the above-described embodiments, the aforementioned mounting sheet is used for attachment of the bow to an article to be adorned therewith. For this purpose, the mounting sheet is coated with a pressure-sensitive adhesive layer which is normally covered by a peel-off protective backing. Upon removal of the backing, the exposed adhesive layer can be pressed against and secured to the article.

Another feature of this invention resides in a see-through container in which the netting is closely confined. The container prevents damage of the netting during transport, and serves as a convenient point-of-sale display package by which a prospective customer can inspect the decoration.

The novel features which are considered as characteristic of the invention are set forth in particular in the appended claims. The invention itself, however, both as to its construction and its method of operation, together with additional objects and advantages thereof, best will be understood from the following description of specific embodiments when read in connection with the accompanying drawings.

BRIEF DESCRIPTION OF THE DRAWINGS

FIG. 1 is a front perspective view of one embodiment of a decoration in a bow-unformed condition according to this invention;

FIG. 2 is a front perspective view of the decoration of FIG. 1 in a bow-formed condition;

FIG. 3 is a side view of another embodiment of a decoration in a bow-unformed condition according to this invention;

FIG. 4 is a side view of the decoration of FIG. 3 in a bow-formed condition;

FIG. 5 is a side view of yet another embodiment of a decoration in a bow-unformed condition according to this invention;

FIG. 6 is a perspective view of the decoration of FIG. 1 in a bow-unformed condition in close confinement within a shipping/display container;

FIG. 7 is an enlarged view of the netting utilized in the decorations according to this invention;

FIG. 8 is a greatly enlarged sectional view taken on line 8—8 of FIG. 7;

DETAILED DESCRIPTION OF THE PREFERRED EMBODIMENTS

Figure 9:
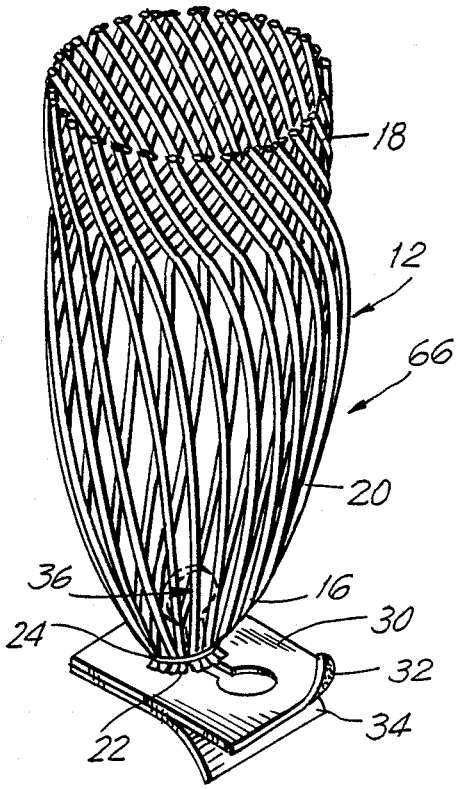
FIG. 9 is a front perspective view of an additional embodiment of a decoration in a bow-unformed condition according to this invention.

Referring now to the drawings, a first embodiment of a decoration 10 is shown in an unformed or shipping condition in FIG. 1, and in a formed or completed condition in FIG. 2. The decoration 10 includes a netting 12 having pliable elongated strands 14 of synthetic plastic material. Preferably, a light, spongy, expanded, plastic material made by introducing pockets of air or gas is employed. However, any synthetic plastic material can be utilized, as well as non-expanded plastic foam.

As best shown in FIG. 7, the strands intersect one another and form an openwork pattern having open spaces. As best shown in FIG. 8, the strands are joined at their points of intersection, preferably by heat fusion or with an adhesive. In a preferred manufacturing process, the plastic materials are extruded through extrusion dies which are rotated about a central axis of symmetry at a certain predetermined speed. Changing the speed of rotation changes the size of the open spaces of the resultant netting. The extruded plastic materials are somewhat tacky at their outer surfaces immediately upon exiting the rotating dies and, hence, upon setting, the overlying extruded plastic material strands stick to one another.

Returning to FIG. 1, the netting 12 extends longitudinally along an axis from one axial end region 16 to an opposite axial end region 18. Between end regions 16, 18, the netting has a circumferentially-complete central region 20 which extends entirely about the axis for a predetermined peripheral distance.

As described so far, the netting 12 has a generally cylindrical shape with the strands 14 extending generally between the end regions 16, 18. At end region 16, end portions of the strands thereat are gathered in a common bunch 22 and tied together by a tie 24 so as to be securely fastened together. As described below, end portions of the strands at the other end region 18 are movable toward the bunch 22 in order to form the decorative bow shown in FIG. 2.

The strands are advantageously oriented along directions that are inclined relative to the axis. As shown in FIG. 7, a first set 26 of the strands extends along a first direction, whereas a second set 28 of the strands extends along a second direction which forms an obtuse angle, e.g. 135°, with the first direction. The intersecting sets of strands advantageously form quadrilateral, e.g. rhomboidal, open spaces in the netting. In the gathered netting of FIG. 1, the sets 26, 28 of the strands do not extend linearly along said first and second directions, but, instead, due to the generally conical shape of the netting, extend along curved courses which extend helically about said longitudinal axis of the netting.

As also shown in FIG. 1, a mounting sheet 30 has a pressure-sensitive adhesive layer 32 normally covered by a peel-off protective backing 34. Upon removal of the backing 34, the adhesive layer 32 on the underside of the mounting sheet 30 is exposed. By pressing the adhesive layer 32 onto a gift or package, the mounting sheet is affixed securely thereto.

Pre-formed score lines, advantageously in the form of a keyhole, are provided in the sheet 30. When pressure is applied against the score lines, a keyhole-shaped tongue 36 having an enlarged head 40 and a stem 38 is severed and struck out from the sheet 30. The stem 38 remains attached to the sheet 30. The tongue 36 is introduced between the end portions of the strands prior to being gathered into the bunch 22 and tied by the tie 24, thereby capturing the enlarged head 40 in the bunch and providing a one-piece assembly for the decoration to include the netting and the mounting sheet.

In order to re-configure the generally conical netting of FIG. 1 to assume the generally umbrella-like or mushroom-like shape depicted in FIG. 2, it is merely necessary, once the mounting sheet 30 and netting 12 have been affixed to an article to be adorned, to displace the movable end portions in a radially outward direction and concomitantly in a downward direction toward the bunch 22. During this displacement, the axial end region 18 is folded in an inside-outside manner over the central region 20 of the netting. In other words, the inner and outer circumferential surfaces of the end region 18 depicted in FIG. 1 respectively constitute the outer and inner surfaces of the end region 18 in FIG. 2 after displacement. The pliability of the strands 14 facilitates this displacement and resists ripping or other damage to the strands. The heat-fused joints do not separate during said folding. The extreme ends of the movable end portions are arranged along a circular locus extending about said longitudinal axis for a distance greater than said peripheral distance of the central region 20 at end region 18 in FIG. 1 and, after folding, the ends of the movable end portions seek to return to the same circular locus due to the inherent resilience of the strands. This self-returning characteristic maintains the decoration in the bow-formed condition resembling an umbrella or mushroom depicted in FIG. 2.

A second embodiment of a decoration 50 is shown in a bow-unformed condition in FIG. 3, and in a bow-formed condition in FIG. 4. The decoration 50 includes the very same netting 12 described above in connection with decoration 10 and, hence, will not be repeated for the sake of brevity, except that the movable end portions at said opposite axial end region 18 are gathered in a common bundle 52 and tied by a common tie 54, thereby imparting a banana-like shape to the unformed bow. A drawstring 56 has one end 58 connected to the common bundle 52. The drawstring 56 is routed through the interior of the netting 12 and through the common bunch 22 with clearance so that the drawstring can pass freely through the bunch 22. The drawstring 56 also extends through the keyhole-shaped slot formed through the mounting sheet 30, and terminates in an opposite end 60 which is accessible to the user. In use, the user need only pull the end 60 along the axial direction to displace the common bundle 52 toward the bunch 22, as shown in FIG. 4, wherein a generally spherical shape is imparted to the formed bow.

The user need not stop the pulling movement when the spherical-shaped bow of FIG. 4 has been achieved, but may, in fact, continue the pulling movement until the bundle 52 engages the bunch 22, thereby imparting a bowl-like shape to the completed bow.

In another embodiment, the drawstring 56 need not be utilized when both axial end regions have been gathered together. Instead, as shown in FIG. 5, a fastening means 62 may be fixedly secured at common bundle 52, and a complementary fastening means 64 can be securely fastened at common bunch 22. The fastening means 62 is shown as a bulbous snap-type projection which engages with snap-type action a complementary contoured recess 64. The user need only push the projection 62 along the axial direction and snap the projection 62 into the recess 64 in order to form a dish-like shape for the bow. Virtually any fastener and complementary fastener means may be utilized. A pres- sure-sensitive adhesive is particularly advantageous in this application for use as the fastening means, in which case, a paper sheet would be provided at the bunch 22 so as to be adhesively secured to the adhesive at bundle 52.

Figure 10:
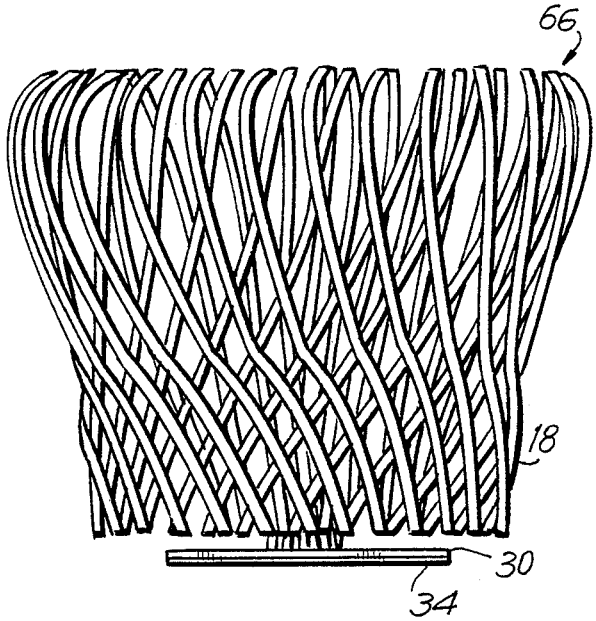
FIG. 10 is a side view of the decoration of FIG. 9 in a bow-formed condition.

An additional embodiment of a decoration 66 is shown in a bow-unformed condition in FIG. 9, and in a crown-shaped bow-formed condition in FIG. 10. The decoration 66 has the same netting as previously described in connection with the embodiment of FIGS. 1 and 2 and, hence, will not be repeated for the sake of brevity, except that the opposite axial end region 18 is cylindrical in cross-section due to the fact that the first and second sets of strands are inclined along directions that form a 45° angle therebetween so as to form the open spaces as squares. This change in the inclination angle between the first and second sets of strands may be advantageously achieved by changing the speed of rotation of the aforementioned extrusion dies.

It is also within the scope of this invention to not only change the rotary speed of the extrusion dies, but to change the cross-sectional area of the discharge orifice of the dies so that the cross-section of the resultant extruded strands are variable as well.

In the case of the FIG. 9 embodiment, it is advantageous if the strands for the cylindrical end region 18 have a reduced cross-section as compared to that of the strands in the central region 20.

Just as in the case of the embodiment of FIGS. 1 and 2, the user need only displace the movable end portions of end region 18 radially outwardly and downwardly toward the gathered stationary end portions at bunch 22 in order to form the crown-like bow of FIG. 10. The circular locus of the free ends of the movable end portions of axial end region 18 extends for a distance which is slightly less than said peripheral distance of the central region 20 in the FIG. 9 embodiment so that the formed bow maintains its shape somewhat better than that disclosed in the FIG. 2 embodiment.

Figure 11:
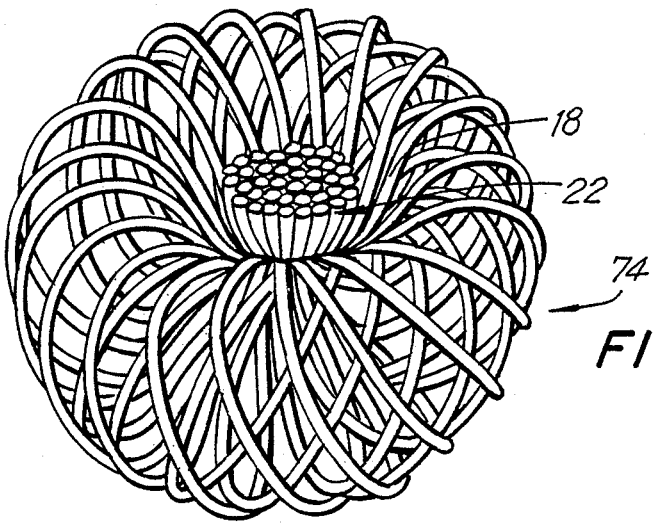
FIG. 11 is a top perspective view of a further embodiment of a decoration in a bow-formed condition according to this invention.
Figure 12:
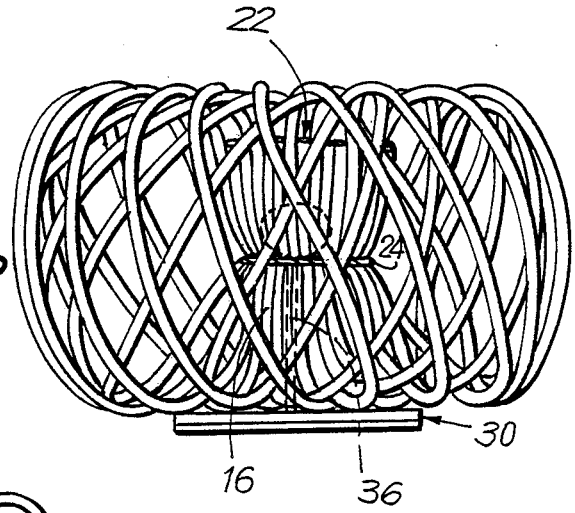
FIG. 12 is a side view of the decoration of FIG. 11, with an attached mounting sheet.
Figure 13:
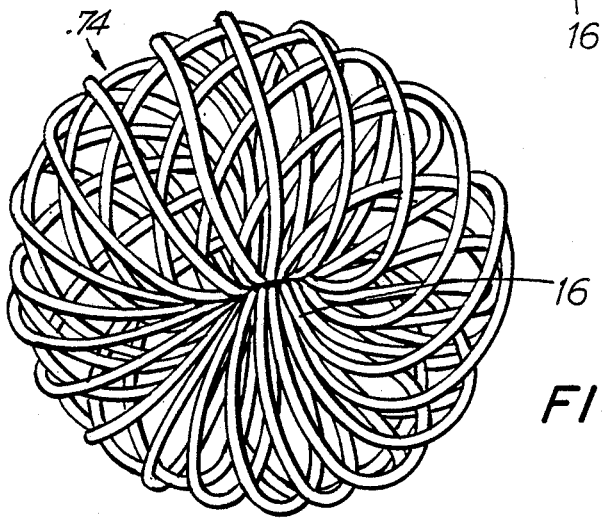
FIG. 13 is a bottom perspective view of the decoration of FIG. 11, with the mounting sheet removed for the sake of clarity.

Turning next to the embodiment of FIGS. 11–13, a ball-shaped decoration 74 is depicted in the bow-formed condition. The decoration 74 has the same netting as previously described and, hence, will not be repeated for the sake of brevity, except to point out that the stationary end portions at end region 16 are gathered in a common bunch 22 and tied together by a tie 24 somewhat further away from the stationary end portions as compared to the embodiment of FIGS. 1 and 2 to form tufts. As best shown in FIG. 11, this accentuates the heights of the tufts extending outwardly of the decoration, and imparts a particularly ornamental appearance for the top of the decoration. Since the tufts extend from the top of the decoration, the tongue 36 of the mounting sheet 30 (see FIG. 12) extends axially into the interior of the netting.

As before, the movable end portions at the opposite end region 18 are displaced radially outwardly and, this time, upwardly toward the stationary end portions. Thereupon, the movable end portions are displaced axially over and past the tufts at end region 16. The movable end portions are arranged along a circular locus whose length is much smaller than the predetermined peripheral distance of the central region 20. Indeed, the locus of the movable end portions is on the same order of magnitude as, and slightly larger than, the circumference of the tie 24 so that the movable end portions can be tucked in behind the tufts and retained in position by the tufts.

Returning to the embodiment of FIGS. 3 and 4, still another modification resides in tying the netting at longitudinally spaced-apart locations lengthwise along the netting. Thus, rather than solely tying the movable end portions at said one axial end region by tie 54, one or more additional ties, identical to tie 54, can tightly surround the netting. The drawstring 56 is routed through each tie with clearance so that the drawstring can pass freely through the ties. Upon pulling the drawstring, a ball-like shape is formed between each pair of ties. By varying the spacing between adjacent ties, ball-like shapes of different volumes can be made, thereby creating still further attractive designs.

It is also within the scope of this invention to displace the movable end portions radially inwardly and downwardly toward the stationary end portions in order to form still another shape for the completed bow.

In all of the aforementioned embodiments, the decoration in the unformed condition is densely packaged inside a see-through cylindrical container 70 shown in FIG. 5 with a removable cap 72. The netting is easily folded in a compact state, and is closely confined within the container 70 so as to be shipped in a small volume of space. The container 70 makes for an attractive and easily handled point-of-sale display container whereby the user can inspect the decoration prior to purchase.

It will be understood that each of the elements described above, or two or more together, also may find a useful application in other types of constructions differing from the types described above.

While the invention has been illustrated and described as embodied in a decorative netting bow and method of making same, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. A bow-forming decoration, comprising:

a tubular netting having pliable, elongated strands of synthetic plastic material intersecting one another and forming an open-work pattern having open spaces, said strands being joined at their points of intersection, said tubular netting extending longitudinally along an axis from one axial end region of the netting to an opposite axial end region thereof, said netting having a circumferentially-complete tubular central region intermediate said end regions and extending circumferentially completely about said axis, said strands having stationary end portions at said one axial end region that are gathered in a common bunch, and said strands having movable end portions at said opposite axial end region that are movable toward said common bunch and form a decorative bow.

2. The decoration as recited in claim 1, wherein said strands include a first set extending between said end regions along a first direction, and a second set extending between said end regions along a second direction inclined relative to said first direction and forming said open spaces with a quadrilateral shape.

3. The decoration as recited in claim 2, wherein said first set of strands also extends along a third direction between said end regions, said third direction being inclined relative to said first direction, and wherein said second set of strands also extends along a fourth direction between said end regions, said fourth direction being inclined relative to said second direction.

4. The decoration as recited in claim 1, wherein said strands have heat-fused joints at their points of intersection.

5. The decoration as recited in claim 1, wherein said netting is reconfigurable between a bow-unformed condition and a bow-formed condition.

6. The decoration as recited in claim 5, wherein said movable end portions are displaceable radially outwardly toward the stationary end portions during movement between the bow-unformed and bow-formed conditions.

7. The decoration as recited in claim 6, wherein said movable end portions are arranged in a circular locus in both said bow-unformed and bow-formed conditions, and wherein said opposite axial end region is foldable in an inside-outside manner over said central region.

8. The decoration as recited in claim 7, wherein said central region extends circumferentially about said axis for a predetermined circumferential distance, and wherein said movable end portions extend circumferentially about said axis for a distance greater than said predetermined circumferential distance so that said netting has a generally conical shape in the bow-unformed condition, and a mushroom-like shape in the bow-formed condition.

9. The decoration as recited in claim 7, wherein said central region extends circumferentially about said axis for a predetermined circumferential distance, and wherein said movable end portions extend circumferentially about said axis for a distance less than said predetermined circumferential distance so that said central region and said one axial unformed condition, and wherein said opposite axial end region has a generally cylindrical shape in the bow-unformed condition, and wherein said netting has a crown-like shape in the bow-formed condition.

10. The decoration as recited in claim 7, wherein said stationary end portions are gathered in the common bunch by a tie which extends circumferentially about said axis for a predetermined length, and wherein said movable end portions extend circumferentially about said axis for a distance greater than said predetermined length, and wherein said movable end portions are displaceable axially over and past said common bunch to form a ball-like shape in the bow-formed condition.

11. The decoration as recited in claim 5, wherein said movable end portions are gathered in a common bundle; and further comprising a drawstring having one end connected to said common bundle, said drawstring extending interiorly through the netting and with freedom of movement through the common bunch, and wherein said movable end portions are pulled along the axis toward the stationary end portions during movement between the bow-unformed and bow-formed conditions.

12. The decoration as recited in claim 11, wherein said netting has a generally banana-like shape in the bow-unformed condition, and a generally spherical shape in the bow-formed condition.

13. The decoration as recited in claim 1; and further comprising a mounting sheet for attachment to an article to be adorned with the bow, said sheet having an upright tongue struck out from the sheet and positioned intermediate the stationary end portions, and also comprising a tie tightly surrounding the stationary end portions and the tongue for fastening the bow to the sheet.

14. The decoration as recited in claim 13, wherein said sheet has an adhesive layer exposable by a peel-off protective backing.

15. The decoration as recited in claim 1; and further comprising a see-through container in which the netting is closely confined.

16. A method of forming a decoration, comprising the steps of:

forming a tubular netting of intersecting, pliable, elongated strands of synthetic plastic material in an open-work pattern having open areas, and joining the strands at their points of intersection, said tubular netting extending longitudinally along an axis from one axial end region of the netting to an opposite axial end region thereof, said netting having a circumferentially-complete tubular central region intermediate said end regions and extending circumferentially completely about said axis, gathering stationary end portions of strands located at said one axial end region in a common bunch, and moving movable end portions of strands located at said opposite axial end region toward said common bunch, and forming a decorative bow.

17. The method as recited in claim 16, wherein said moving step reconfigures the netting between a bow-unformed condition and a bow-formed condition.

18. The method as recited in claim 17, wherein said moving step is performed by displacing the movable end portions radially outwardly and toward the stationary end portions with concomitant folding of said opposite axial end region in an inside-outside manner over said central region.

19. The method as recited in claim 17, wherein said moving step is performed by gathering the movable end portions in a common bundle, and by tying one end of a drawstring to the common bundle and by pulling the drawstring through the netting and through the common bunch along the axis.

20. The method as recited in claim 16; and further comprising the step of fastening a mounting sheet to the stationary end portions, and exposing an adhesive layer on the mounting sheet.

21. The method as recited in claim 16, wherein said forming step is performed by arranging the strands to intersect at different angles of inclination lengthwise of the netting.

22. A bow-forming decoration, comprising:

a tubular netting having pliable, elongated strands of synthetic plastic material intersecting one another and forming an open-work pattern having open spaces, said strands being joined at their points of intersection, said tubular netting extending longitudinally along an axis from one axial end region of the netting to an opposite axial end region thereof, said netting having a circumferentially-complete tubular central region intermediate said end regions and extending circumferentially completely about said axis, said strands having stationary end portions at said one axial end region that are gathered in a common bunch, fastening means securely mounted at said common bunch, said strands having movable end portions at said opposite axial end region that are gathered in a common bundle, and complementary fastening means securely mounted at said common bundle and engageable with said fastening means to form a decorative bow upon movement of said common bundle to said common bunch.

23. The decoration as recited in claim 22, wherein said strands are constituted of expanded plastic material.

* * * * *